US006694118B2

(12) United States Patent
Yoo

(10) Patent No.: US 6,694,118 B2
(45) Date of Patent: Feb. 17, 2004

(54) DEVELOPING APPARATUS OF ELECTROPHOTOGRAPHIC PRINTER

(75) Inventor: Yong-baek Yoo, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/319,841

(22) Filed: Dec. 16, 2002

(65) Prior Publication Data

US 2003/0129003 A1 Jul. 10, 2003

(30) Foreign Application Priority Data

Jan. 10, 2002 (KR) ..... 10-2002-0001381

(51) Int. Cl.[7] ..... G03G 15/01
(52) U.S. Cl. ..... 399/228
(58) Field of Search ..... 399/54, 113, 119, 399/126, 223, 226, 227, 228

(56) References Cited

U.S. PATENT DOCUMENTS 5,420,676 A * 5/1995 Arcaro ..... 399/54
5,666,599 A * 9/1997 Miyasaka et al. ..... 399/223
6,501,923 B2 * 12/2002 Aoki et al.

FOREIGN PATENT DOCUMENTS

JP 04076565 A * 3/1992 ..... G03G/15/01

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A developing apparatus of an electrophotographic printer for developing an image on a photoreceptive drum includes a disc rotating independently of the photoreceptive drum at both sides of the photoreceptive drum and having at least one cam groove formed on an outer circumferential surface thereof. A developing unit includes a housing containing developer and a developing roller supported by both side-walls of the housing and having a shaft contacting the outer circumferential surface of the disc. An elastic member is provided at a rear surface of the housing and presses the developing apparatus toward the photoreceptive drum. Thus, since the disc having at least one cam groove is provided on the outer circumferential surface and rotates independently of the photoreceptive drum, the developing roller can be detached from the photoreceptive drum at a predetermined pressure.

41 Claims, 7 Drawing Sheets

DEVELOPING APPARATUS OF ELECTROPHOTOGRAPHIC PRINTER

CROSS-REFERENCE TO RELATED APPLICATIONS

This application claims the benefit of Korean Patent Application No. 2002-1381, filed Jan. 10, 2002, in the Korean Intellectual Property Office, the disclosure of which is incorporated herein by reference.

BACKGROUND OF THE INVENTION

1. Field of the Invention

The present invention relates to a developing apparatus of an electrophotographic printer, and more particularly, to a developing apparatus having a structure of attaching/detaching a developing roller to/from a photoreceptive drum.

2. Description of the Related Art

In general, an electrophotographic printer, such as a color laser printer, includes an image forming apparatus which forms an electrostatic latent image on a photoreceptor and develops the electrostatic latent image using toner. The developed image is transferred to a predetermined transfer medium and retransferred to a sheet of paper therefrom. The transferred image of the paper is heated and pressed to be completely fixed on the paper.

FIG. 1 shows a conventional electrophotographic printer. Referring to FIG. 1, the conventional electrophotographic printer includes a photoreceptive drum 100 which is a photoreceptor, a charger 111 charging the photoreceptive drum 100, an LSU (laser scanning unit) 112, as an exposure unit, scanning a light beam onto the charged photoreceptive drum 100 to form an electrostatic latent image, a developing unit 113 developing the electrostatic latent image by using toner of four colors: yellow (Y), magenta (M), cyan (C), and black (K), a transfer belt 114 sequentially receiving the four colored images developed on the photoreceptive drum 100 to overlap one another, a first transfer roller 114*a* transferring the developed images formed on the photoreceptive drum 100 to the transfer belt 114, a second transfer roller 114*b* transferring the image of four overlapping colors on the transfer belt 114 to a sheet of paper, and a fusing unit 115 fusing the transferred image by heating and pressing the paper. The conventional electrophotographic printer further includes a paper cassette 116 containing sheets of paper, a cleaning unit 117 cleaning a surface of the photoreceptive drum 100, a discharger 118, and a transfer path 119 along which the paper is exhausted.

In the above structure, the image of four overlapping colors is formed as follows. First, when the photoreceptive drum 100 is charged by the charger 111 to a predetermined electric potential, the LSU 112 scans the light beam to form an electrostatic latent image of a first color to be developed with first color toner. A developing unit of the first color first accesses toward the surface of the photoreceptive drum 100 to develop the electrostatic latent image of the first color. For example, if a yellow color is to be developed first as shown in FIG. 2A, a yellow color developing unit 113-Y accesses the photoreceptive drum 100 to develop the electrostatic latent image formed on the photoreceptive drum 100 using yellow color toner. Here, remaining developing units of other colors maintain a particular gap with the photoreceptive drum 100 to be separated from the surface of the photoreceptive drum 100. The developed yellow image is transferred to the transfer belt 114. When the development of the yellow color is complete, the yellow color developing unit 113-Y retreats from the photoreceptive drum 100.

Next, the electric potential supplied to the photoreceptive drum 100 is removed from the photoreceptive drum 100 by the discharger 118. Then, another electrostatic latent image of a second color is formed on the photoreceptive drum 100 by charging and exposing of the photoreceptive drum 100. For example, if the second color to be developed is magenta as shown in FIG. 2B, a magenta color developing unit 113-M accesses the photoreceptive drum 100 to develop the electrostatic latent image using magenta color toner. The developed magenta image is transferred to the transfer belt 114 to which the yellow image has been previously transferred, and thus overlaps the yellow image. Third and fourth colors, for example, cyan and black, are developed in the same manner while each developing unit repeats access and retreat movements with respect to the photoreceptive drum 100.

FIG. 3 shows a structure of a conventional developing apparatus of the electrophotographic printer. Here, although a description is limited to the yellow color developing unit 113-Y, it can be equally applied to the other color developing units. The yellow color developing unit 113-Y includes a housing 121 containing toner 120, a developing roller 122 having the toner 120 adhering to the surface thereof and developing an electrostatic latent image of the yellow color formed on the photoreceptive drum 100 with the toner 120, and a supply roller 124 cleaning a surface of the developing roller 122 and supplying the toner 120 to the developing roller 122. A cam 125 and a shock prevention plate 127 are disposed on a rear side of the housing 121 to control the housing 121 to access toward the photoreceptive drum 100. The developing apparatus includes a doctor blade 128 to allow the toner 120 to adhere to the surface of the developing roller 122 with a uniform thickness.

The yellow color developing unit 113-Y accesses or retreats with respect to the photoreceptive drum 100 by an operation of the cam 125. In doing so, during one turn of the photoreceptive drum 100, a developing roller of a color to be developed contacts the surface of the photoreceptive drum 100 while developing rollers of the other colors are maintained to be separated therefrom. The yellow color developing unit 113-Y retreats from the photoreceptive drum 100 by a rotation of the cam 125 after the development of the yellow color is completed. Then, another color developing unit of a subsequent color accesses the photoreceptive drum 100.

Consequently, all colors are completely developed through the above development processes, and a desired color image is finally formed on the transfer belt 114. Here, in order to transfer the respective color images onto the transfer belt 114 to overlap one another, the photoreceptive drum 100 and the transfer belt 114 need to be matched in rotation period, and the photoreceptive drum 100 and the transfer belt 114 rotate one time for each color. Then, the desired color image completely formed through the above development processes is transferred to the sheet of paper supplied between the transfer belt 114 and the second transfer roller 114*b*. While passing through the fusing unit 115, the paper is heated and pressed so that the color image is completely fixed to the paper. The paper is exhausted along the transfer path 119.

However, since the photoreceptive drum 100 is cylindrical, when the developing units 113-Y, 113-M, 113-C, and 113-K for yellow, magenta, cyan, and black colors, respectively contact the photoreceptive drum 100 in the development processes, contact angles between the photoreceptive drum 100 and the respective developing rollers 122 are different. Thus, since a direction of a force received from a contact portion of each developing unit against the photoreceptive drum 100 is different from that of other developing units, a constant pressure and position is not maintained during performing the development processes. Also, the developing roller 122 cannot stably contact the photoreceptive drum 100 in response to a linear movement of the developing unit 113 by the cam 125. Further, apparatuses for driving the cam 125 are additionally installed in the conventional developing apparatus. In a case of the printer shown in FIG. 1, since the paper transfer path 119 is complicatedly located in a rear side of the developing unit 113, it is difficult to secure a space for the additional apparatuses in the conventional electrophotographic printer.

SUMMARY OF THE INVENTION

To solve the above and other problems, the present invention provides a developing apparatus of an electrophotographic printer in which a contact force of the developing roller for each color is uniformly applied with respect to the photoreceptive drum, and the developing roller is coupled to the photoreceptive drum such that a shock can be minimized.

Additional aspects and advantages of the invention will be set forth in part in the description which follows and, in part, will be obvious from the description, or may be learned by practice of the invention.

According to one aspect of the present invention, a developing apparatus of an electrophotographic printer for developing an image on a photoreceptive drum comprises a disc rotating independently of the photoreceptive drum, disposed on at least one of both sides of the photoreceptive drum, and having at least one cam groove formed on an outer circumferential surface thereof, a developing unit including a housing containing a developer and a developing roller supported by both side walls of the housing and having a shaft contacting the outer circumferential surface of the disc, and an elastic member provided at a rear surface of the housing and pressing the developing unit toward the photoreceptive drum.

According to another aspect of the present invention, the disc has a diameter greater than that of the photoreceptive drum. When the shaft is disposed in the cam groove, the developing roller contacts the photoreceptive drum. The disc is installed to be coaxial with the photoreceptive drum. A bearing is provided around the shaft so that the bearing is disposed to rotate between the shaft and the outer circumferential surface of the disc. The developing apparatus further comprises a power transfer unit using a motor or a gear to drive the disc. Two or more cam grooves are provided at an identical interval along the outer circumferential surface of the disc. The above developing apparatus further comprises a supply roller installed adjacent to the developing roller to supply the developer to the developing roller.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
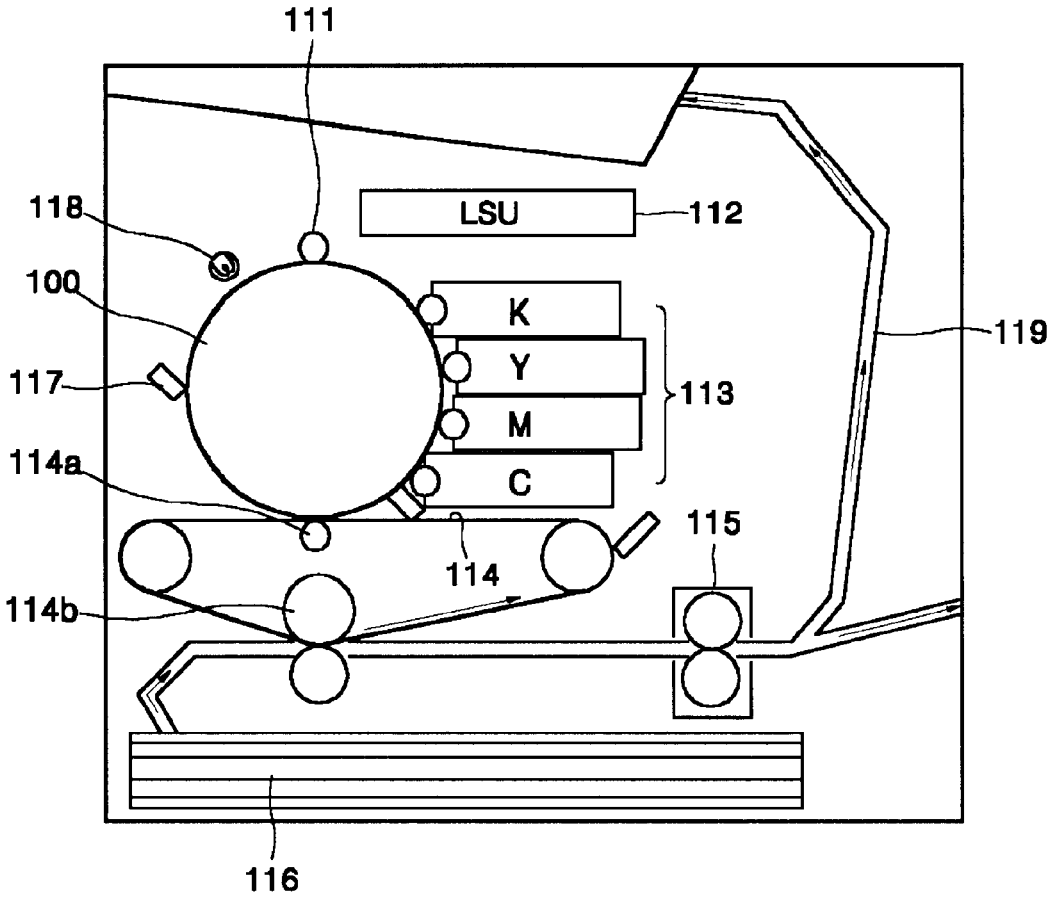
FIG. 1 (PRIOR ART)
FIG. 1 is a view showing a conventional electrophotographic printer.
Figure 2A:
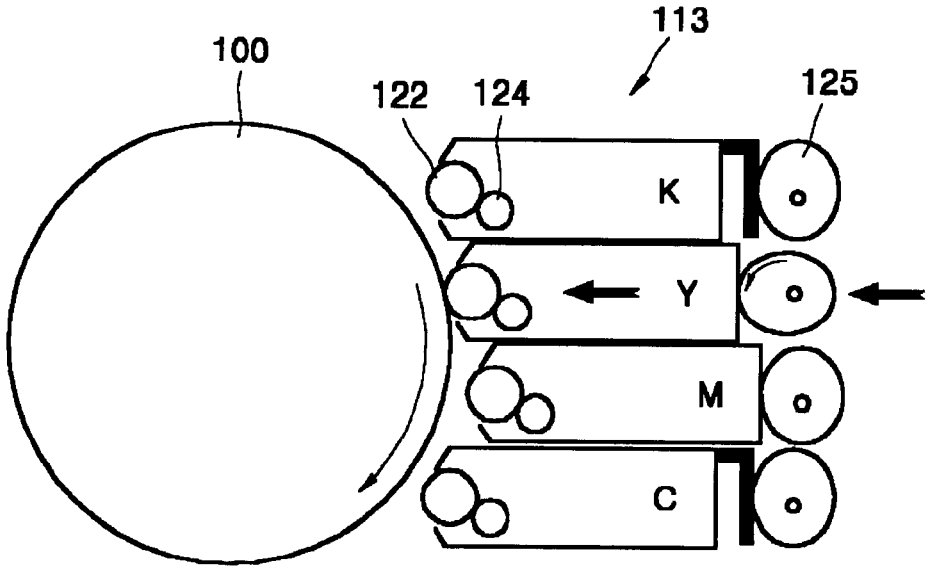
FIG. 2A (PRIOR ART)
FIGS. 2A and 2B are views explaining a development process of the conventional electrophotographic printer shown in FIG. 1.
Figure 2B:
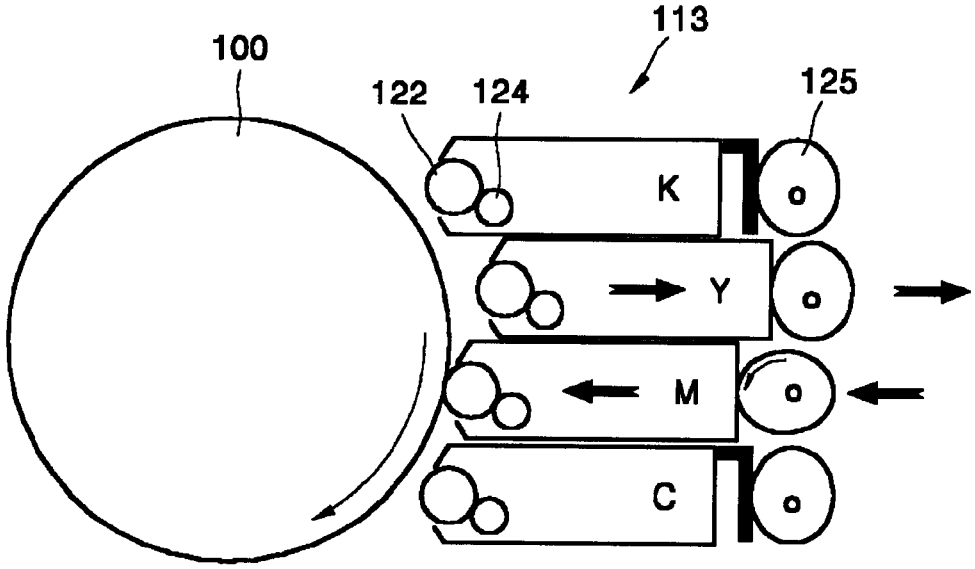
FIG. 2B (PRIOR ART)
Figure 3:
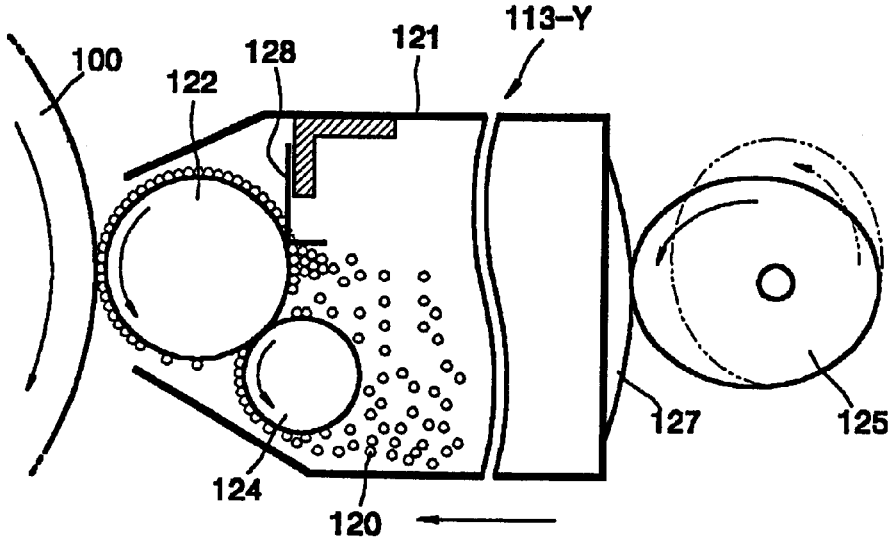
FIG. 3 (PRIOR ART)
FIG. 3 is a view showing a developing apparatus adopted in the conventional electrophotographic printer shown in FIG. 1.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 4:
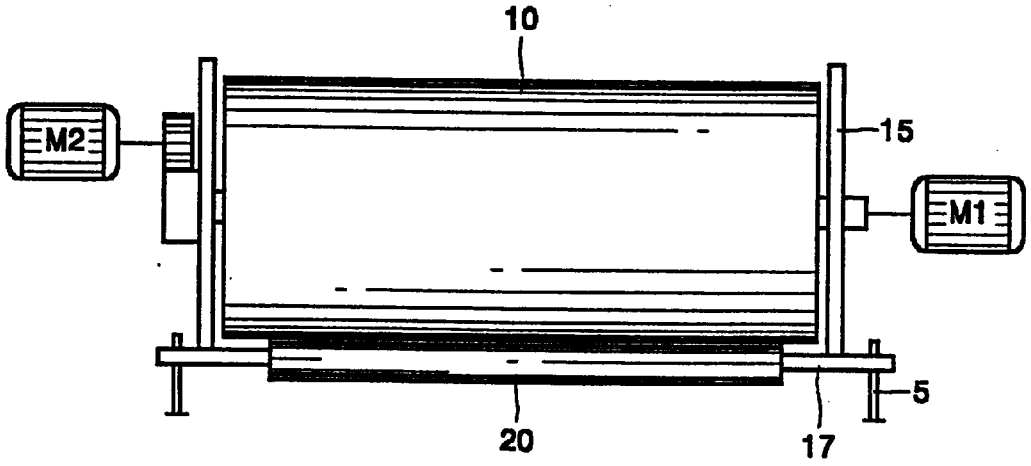
FIG. 4 is a view showing a developing apparatus of an electrophotographic printer according to an embodiment of the present invention.
Figure 5A:
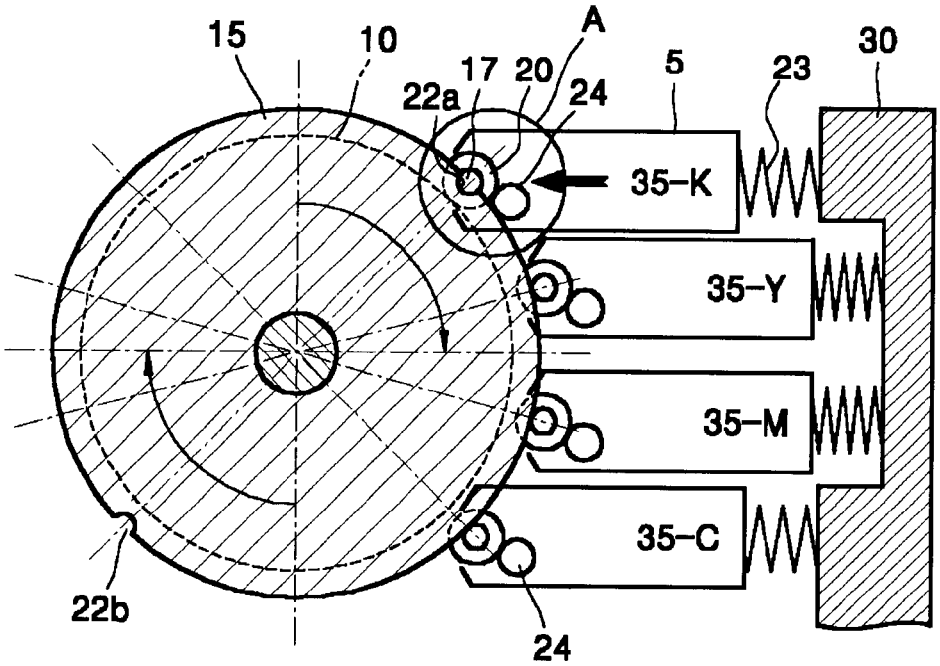
FIGS. 5A and 5B are views showing operational states of the developing apparatus of the electrophotographic printer as shown in FIG. 4.

A developing apparatus of an electrophotographic printer according to an embodiment of the present invention as shown in FIGS. 4 and 5A, includes a disc 15 installed at each side of the photoreceptive drum 10 to rotate independently of the photoreceptive drum 10 and having a diameter greater than that of the photoreceptive drum 10, a housing 5 accommodating toner, a developing roller 20 installed at the housing 5 and having a shaft 17 contacting an outer circumference surface of the disc 15, and an elastic member 23 installed at a rear side of the housing 5 and pressing the housing 5 toward the photoreceptive drum 10. The elastic member 23 is installed on a bracket 30 to bias the housing 5 with respect to the photoreceptive drum 100.

The developing apparatus having the above structure includes four developing units 35-K, 35-Y, 35-M, and 35-C for black (K), yellow (Y), magenta (M), and cyan (C) colors which are installed in order and disposed to be adjacent to one another along the outer circumferential surface of the photoreceptive drum 10.

Figure 5B:
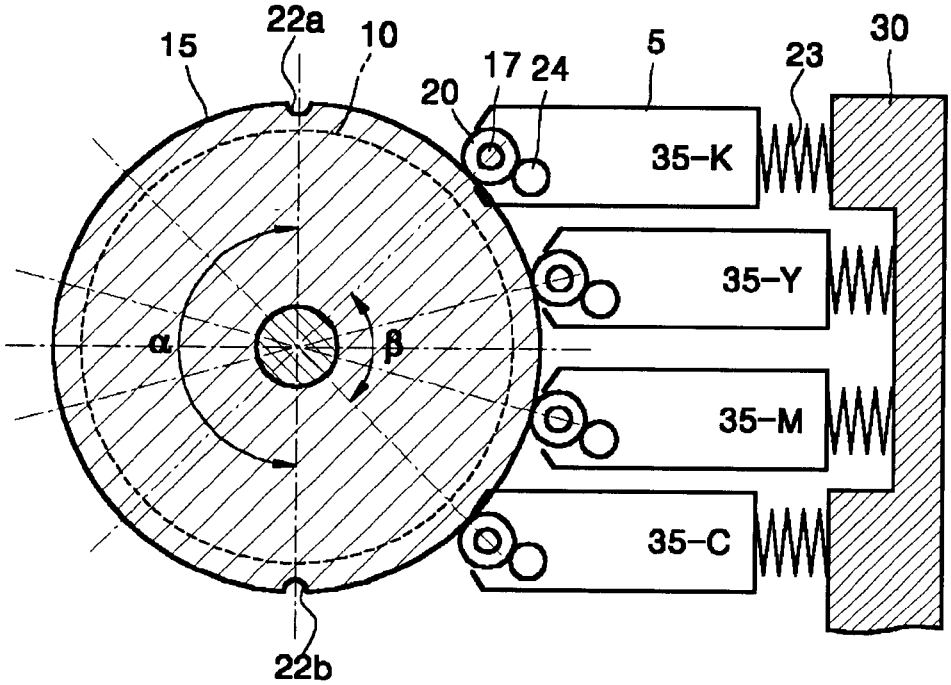

According to an aspect to the present invention, the diameter of the disc 15 is greater than that of the photoreceptive drum 10, and at least one cam groove is formed on the outer circumferential surface of the disc 15. For example, FIGS. 5A and 5B show a case in which two cam grooves, first and second cam grooves 22*a* and 22*b*, are formed on the outer circumferential surface of the disc 15. Also, a first motor M1 rotating the photoreceptive drum 10 and a second motor M2 rotating the disc 15 independently of the photoreceptive drum 10, are provided in the developing apparatus. FIG. 4 shows one developing roller 20 only while omitting the housing 5, in order to show a relationship between the developing roller 20 and the disc 15. The shaft 17 of the developing roller 20 is rotatably installed at the housing 5 and disposed to rotate by contacting the outer circumferential surface of the disc 15. Since the elastic member 23 presses (biases) the housing 5 toward the photoreceptive drum 10, the shaft 17 is pressed (biased) toward the disc 15. Accordingly, when the disc 15 rotates, the shaft 17 rotates along a curve made by the outer circumferential surface of the disc 15 and the first and second cam grooves 22*a* and 22*b*.

In FIG. 5A, the shaft 17 of a developing roller 20-K for a black (K) color is disposed in the first cam groove 22*a* to develop a black color image. Here, the shafts 17 of other developing rollers for other colors of yellow (Y), magenta (M), and cyan (C) contact the outer circumferential surface of the disc 15 other than the first or second cam groove 22*a*, 22*b*. In FIG. 5B, all developing units 35-K, 35-Y, 35-M, and 35-C for black, yellow, magenta, and cyan colors are turned off and disposed away from the photoreceptive drum 10, that is, in a development completion and ready state. In a case which the disc 15 is formed with two cam grooves, that is, the first and second cam grooves 22*a* and 22*b*, as the disc 15 rotates, the shafts 22 for black, yellow, magenta, and cyan colors are sequentially disposed in the first cam groove 22*a* so that the development of each color is complete. In the same manner, the shafts 22 for black, yellow, magenta, and cyan colors are sequentially disposed in the second cam groove 22*b* so that another development of each color is proceeded and complete.

Although in the above embodiment two cam grooves are provided in the disc 15, it is possible to provide more than two cam grooves on the disc 15. When a plurality of the cam grooves are provided, the cam grooves are arranged on the outer circumferential surface of the disc 15 at identical intervals. Also, when the cam grooves are provided at the identical intervals, assuming that a first section between the cam grooves is $\alpha$, and a second section in which the shafts of black, yellow, magenta, and cyan colors are arranged along the outer circumferential surface of the disc 15, is $\beta$, it is possible that $\alpha>\beta$.

A detaching/attaching operation of the developing roller 20 in the developing apparatus of the electrophotographic printer having the above structure is described below.

Figure 6:
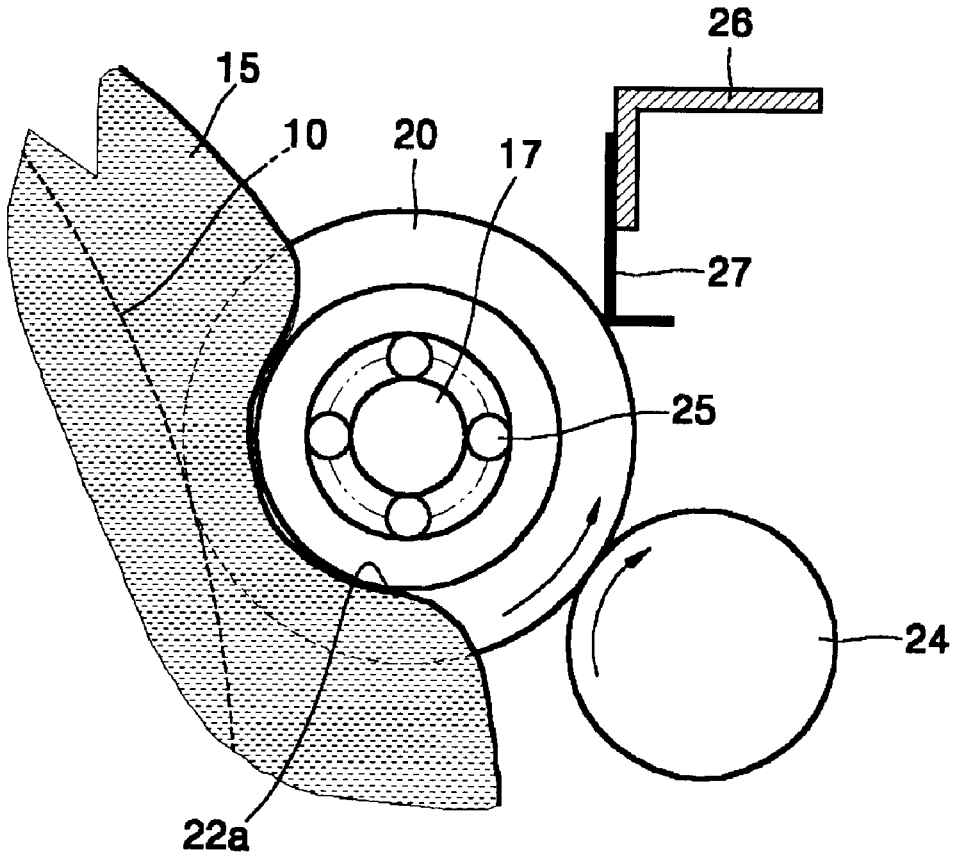
FIG. 6 is en enlarged view showing a circled portion A of FIG. 5A.

For example, when the development of each color is performed in an order of black, yellow, magenta, and cyan, the disc 15 is rotated so that the shaft 17 of the developing roller 20-K for a black color is disposed (received) in the first or second cam groove 22*a* or 22*b*. FIG. 6 is an enlarged view of a portion A of FIG. 5A, showing a state in which the shaft 17 is disposed in the first cam groove 22*a*. As the shaft 17 enters the cam groove 22*a*, the developing roller 20 gradually accesses and contacts the photoreceptive drum 10. When the developing roller 20 contacts the photoreceptive drum 10, the disc 15 stops rotating, and the development of the black color is performed due to an interactive rotation of the photoreceptive drum 20 and the developing roller 20. A bearing 25 is provided on a portion of the shaft 17 contacting the disc 15 so that the developing roller 20 and the disc 15 can freely and independently rotate. The developing apparatus includes a supply roller 24 supplying a developer 33, such as toner, a doctor blade 27 which makes a thickness of the toner 33 adhering to the developing roller 20 uniform, and a bracket 26 supporting the doctor blade 27. While the development of each color is performed, the disc 15 is stopped to maintain a development gap between the developing roller 20 and the photoreceptive drum 10.

Figure 7A:
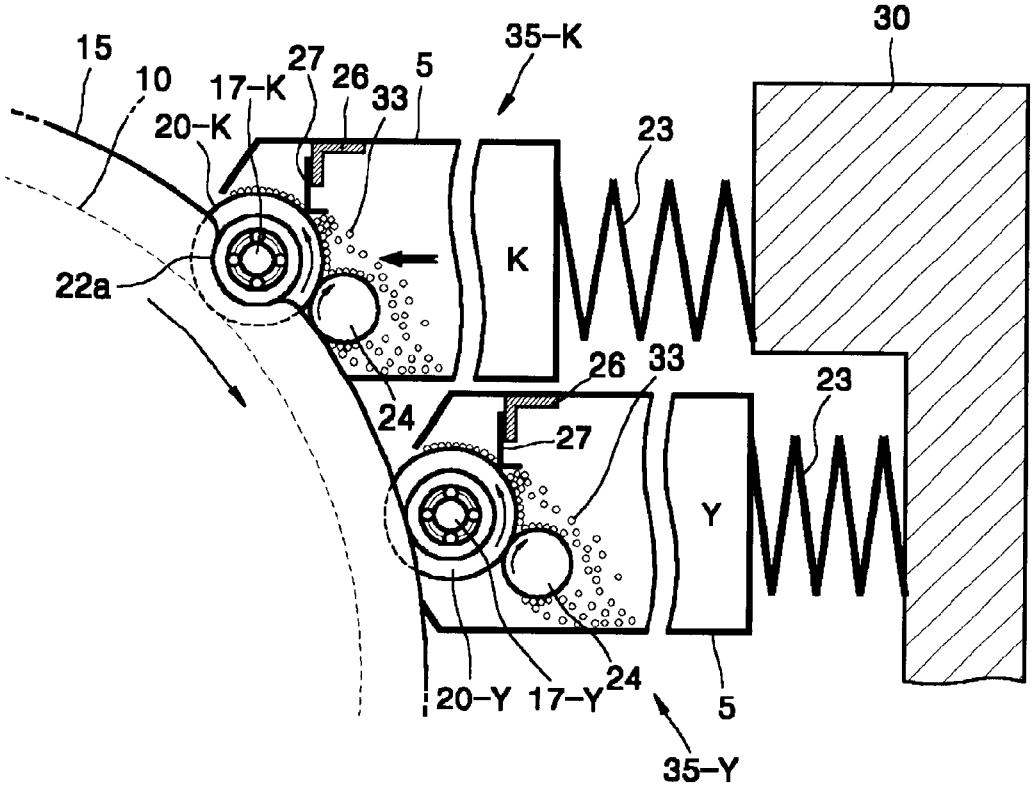
FIGS. 7A and 7B are views explaining the operational states of the developing apparatus in which a developing unit is coupled to the photoreceptive drum.
Figure 7B:
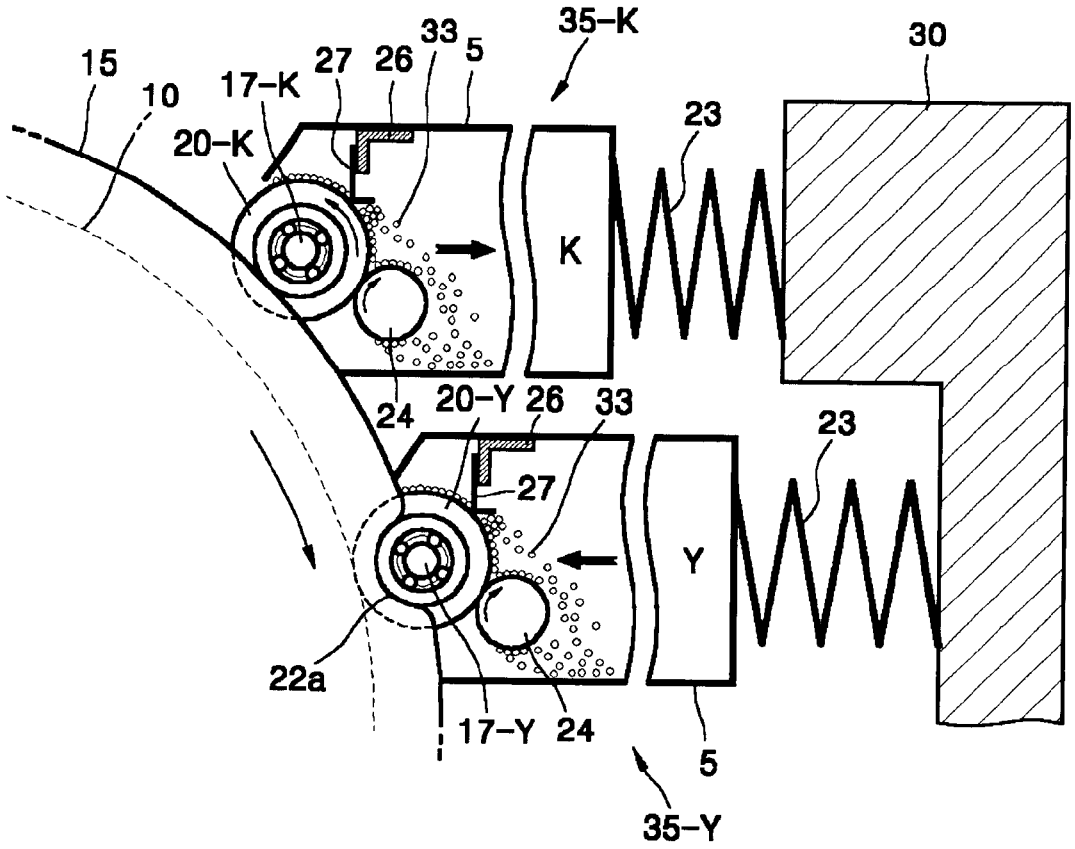

A radial depth of the first cam groove 22*a* may be set such that the developing roller 20 can contact the surface of the photoreceptive drum 10 at a predetermined pressure when the shaft 17 is disposed in the first cam groove 22*a*. Also, when the shaft 17 of the developing roller 20 contacts the outer circumferential surface of the disc 15 except for the cam grooves 22*a*, 22*b*, the developing roller 20 is designed to be separated by a predetermined distance from the photoreceptive drum 10. The disc 15 and the photoreceptive drum 10 are coaxially connected, and the diameter of the disc 15 is greater than that of the photoreceptive drum 10. When the disc 15 is rotated clockwise after the development of the black color is complete as described above in conjunction with FIGS. 7A and 7B, the developing roller 20-K for the black color is separated from the photoreceptive drum 10 when the shaft 15 moves from the cam groove 22*a* to the outer circumferential surface of the disc 15. Next, the shaft 17 of the developing roller 20-Y for a yellow color enters the first cam groove 22*a*. Then, the developing roller 20-Y for the yellow color contacts the photoreceptive drum 10 and performs the development of the yellow color. The first and second cam grooves 22*a* and 22*b* are made to form a smooth curve to alleviate an impact during coupling the developing roller 22 to the photoreceptive drum 10.

Since the shafts 17 corresponding to respective ones of the developing units 20 for the remaining colors contact the outer circumferential surface of the disc 15 during which the development of the yellow color is performed, the developing units 20 for the remaining colors are separated by a predetermined distance from the photoreceptive drum 10. Thereafter, magenta and cyan colors are sequentially developed in the same manner.

In the meantime, the cam grooves can be provided in multiple numbers as described above. For example, when the first and second cam grooves 22*a* and 22*b* are provided, the section $\alpha$ between the first cam groove and the second cam groove is a section where the development by the developing units for black, yellow, magenta, and cyan colors is all complete. When two cam grooves are provided, the development is complete two times during one rotation of the disc. When three cam grooves are provided, the development is complete three times during one rotation of the disc. When a plurality of cam grooves are provided as above, it is possible that the sections between the neighboring cam grooves have the same interval.

Also, in a case of performing the development of a mono color, the disc 15 is rotated in a forward direction to have the shaft 17 of a developing roller 20 for a desired color disposed in the first or second cam groove 22*a* or 22*b*, and then the disc is stopped. After the development is complete, the disc 15 is rotated in a reverse direction so that only a selected developing roller 20 can be continuously coupled to photoreceptive drum 10. In the present invention, a color to be developed can be selected by simply rotating the disc 15.

As described above, in the developing apparatus of the electrophotographic printer according to the present invention, since at least one cam groove is provided at the outer circumferential surface of the disc rotating independently of the photoreceptive drum, the developing roller can be attached/detached to/from the photoreceptive drum with a predetermined pressure. That is, when the developing roller is separated from or contacts the photoreceptive drum, since the developing roller is gradually moved along the cam groove of the disc, the coupling operation between the developing apparatus and the photoreceptive drum becomes smooth. Also since each of the developing units for black, yellow, magenta, and cyan colors accesses the photoreceptive drum at the same linear velocity, a change in a contacting force is small so that a printing quality of an image is improved.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A developing apparatus developing an image on a photoreceptive drum in a printer, the developing apparatus comprising:

a disc rotating independently of the photoreceptive drum in both forward and reverse directions relative to the photoreceptive drum, disposed on a side of the photoreceptive drum and having a cam groove formed on an outer circumferential surface thereof;

a developing unit including a housing containing a developer and a developing roller supported by both sidewalls of the housing and having a shaft contacting the cam groove and the outer circumferential surface of the disc; and an elastic member provided at a surface of the housing to bias the developing apparatus toward the photoreceptive drum.

2. The apparatus as claimed in claim 1, wherein the disc has a diameter greater than that of the photoreceptive drum.

3. The apparatus as claimed in claim 2, wherein the developing roller contacts the photoreceptive drum when the shaft is disposed in the cam groove.

4. The apparatus as claimed in claim 3, wherein the disc is rotatably and coaxially installed on the photoreceptive drum.

5. The apparatus as claimed in claim 4, further comprising:

a bearing provided around the shaft where the shaft and the outer circumferential surface of the disc contact.

6. The apparatus as claimed in claim 5, further comprising:

a power transfer unit driving the disc.

7. The apparatus as claimed in claim 6, wherein the disc comprises:

another cam groove, and the cam groove and another cam groove are equally spaced along the outer circumferential surface of the disc.

8. The apparatus as claimed in claim 3, further comprising:

a bearing provided around the shaft where the shaft and the outer circumferential surface of the disc contact.

9. The apparatus as claimed in claim 8, further comprising:

a power transfer unit driving the disc.

10. The apparatus as claimed in claim 9, wherein the disc comprises:

another cam groove, and the cam groove and another cam groove are equally spaced along the outer circumferential surface of the disc.

11. The apparatus as claimed in claim 1, further comprising:

a supply roller installed adjacent to the developing roller to supply the developer to the developing roller.

12. The apparatus as claimed in claim 1, wherein the disc comprises:

another cam groove, and the cam groove and another cam groove are equally spaced along the outer circumferential surface of the disc.

13. A developing apparatus developing an image on a photoreceptive drum in a printer, comprising:

a disc which is rotatable in both forward and reverse directions relative to the photoreceptive drum and disposed on a side of the photoreceptive drum, and having a surface and a cam groove formed on the surface; and a developing unit including a housing containing a developer and a developing roller supported by the housing, having a shaft disposed to contact one of the cam groove and the surface of the disc, and selectively moving toward and away from the photoreceptive drum during a development process in response to a contact between the shaft and the one of the cam groove and the surface of the disc.

14. The apparatus as claimed in claim 13, wherein the disc rotates at a first speed, and the photoreceptive drum rotates at a second speed.

15. The apparatus as claimed in claim 14, wherein the first speed of the disc varies, and the second speed of the photoreceptive drum does not vary during a development process.

16. The apparatus as claimed in claim 14, wherein the disc rotates intermittently during a continuous rotation of the photoreceptive drum.

17. The apparatus as claimed in claim 14, wherein the disc comprises another cam groove, and the first speed decreases in accordance with an increase of the number of the cam grooves formed on an outer circumferential surface of the disc.

18. The apparatus as claimed in claim 17, wherein the shaft of the developing unit selectively contacts one of the cam groove, the outer circumferential surface, and the another cam groove.

19. The apparatus as claimed in claim 13, wherein the disc comprises:

a curved portion formed between the cam groove and the surface of the disc to allow the developing unit to smoothly contact the photoreceptive drum when the shaft of the developing unit moves from the surface to the cam groove.

20. The apparatus as claimed in claim 13, wherein the cam groove has a depth with respect to the surface, and the depth corresponds to a moving distance of the developing unit with respect to the photoreceptive drum.

21. The apparatus as claimed in claim 13, wherein the surface of the disc comprises:

an outmost circumferential surface facing the shaft of the developing unit.

22. The apparatus as claimed in claim 13, further comprising:

another disc disposed on another side of the photoreceptive drum opposite to the side, having another surface and another cam groove, wherein the shaft of the developing unit is disposed in one of the cam groove and another cam groove during the development process, and the shaft contacts one of the surface and another surface of the disc when the developing unit does not contact the cam groove and another cam groove.

23. The apparatus as claimed in claim 13, further comprising:

a first power transfer unit rotating the disc; and a second power transfer unit rotating the photoreceptive drum.

24. The apparatus as claimed in claim 13, wherein the disc rotates independently of the photoreceptive drum.

25. The apparatus as claimed in claim 13, wherein the disc and the photoreceptive drum rotate in one of a clockwise direction and a counterclockwise direction.

26. The apparatus as claimed in claim 13, wherein the developing unit is attached to the photoreceptive drum to develop the image with the developer when the shaft is disposed in the cam groove of the disc, and detached from the photoreceptive drum when the shaft contacts the surface of the disc.

27. The apparatus as claimed in claim 13, wherein the developing unit is biased toward the photoreceptive drum.

28. The apparatus as claimed in claim 13, further comprising:

an elastic member provided at a surface of the housing to push the developing unit toward the photoreceptive drum and to allow the developing unit to contact the photoreceptive drum when the shaft is disposed in the cam groove.

29. A developing apparatus developing an image on a photoreceptive drum in a printer, comprising:

a disc which is rotatable in both forward and reverse directions relative to the photoreceptive drum and disposed on a side of the photoreceptive drum, having a surface and a cam groove formed on the surface; and a plurality of developing units disposed around the photoreceptive drum, each including a housing containing a developer and a developing roller supported by the housing, each having a shaft disposed to contact one of the cam groove and the surface of the disc, and each selectively moving toward and away from the photoreceptive drum in response to a contact between the shaft and the one of the cam groove and the surface.

30. The apparatus as claimed in claim 29, wherein one of the shafts of the developing units is disposed in the cam groove to allow one of the developing units to contact the photoreceptive drum to develop the image with the developer.

31. The apparatus as claimed in claim 29, wherein respective shafts of the developing units are disposed around the disc to selectively contact one of the cam groove and the surface.

32. The apparatus as claimed in claim 29, wherein the disc rotates in a first speed in a forward direction or a reversed direction, and the photoreceptive drum rotates at a second speed.

33. The apparatus as claimed in claim 32, wherein the photoreceptive drum rotates in the forward direction.

34. A developing apparatus developing an image on a photoreceptive drum in a printer, comprising:

a disc rotating disposed on a side of the photoreceptive drum, having an outer circumferential surface, and having a plurality of cam grooves formed on the outer circumferential surface; and a plurality of developing units disposed around the photoreceptive drum, each including a housing containing a developer and a developing roller supported by the housing, each having a shaft disposed to contact one of the cam grooves and the outer circumferential surface of the disc, and each selectively moving toward and away from the photoreceptive drum in response to a contact between the shaft and one of the cam grooves and the outer circumferential surface of the disc.

35. The apparatus as claimed in claim 34, wherein all of the developing units are disposed between the adjacent cam grooves.

36. The apparatus as claimed in claim 34, wherein the cam grooves comprises a first adjacent cam grooves and a second adjacent cam grooves, and a first number of the developing units are disposed between the first adjacent cam grooves while a second number of the developing unit are disposed between the second adjacent cam grooves.

37. The apparatus as claimed in claim 34, wherein one of the developing units contacts the photoreceptive drum to develop the image with the respective developer in response to the contact between the shaft and one of the cam grooves and the outer circumferential surface of the disc.

38. The apparatus as claimed in claim 34, wherein one of the shafts of the developing units is disposed in one of the cam grooves, and other shafts of the developing units are disposed on the outer circumferential surface of the disc.

39. The apparatus as claimed in claim 34, wherein the shafts of the developing units sequentially move from the outer circumferential surface of the disc to one of the cam grooves and from one of the cam grooves to the outer circumferential surface during a rotation of the disc and sequentially disposed in another one of the cam grooves disposed adjacent to the one of the cam grooves during the rotation of the disc after all of the shafts of the developing units sequentially move from the one of the cam grooves to the outer circumferential surface of the disc during a rotation of the disc.

40. The apparatus as claimed in claim 34, wherein the disc comprises another outer circumferential surface disposed opposite to the outer circumferential surface with respect to one of the cam grooves, and the shafts of the developing units comprise a first shaft disposed on the outer circumferential surface, a second shaft disposed in the one of the cam grooves, and a third shaft disposed on the another outer circumferential surface.

41. A developing apparatus developing an image on a photoreceptive drum in a printer, comprising:

a disc which is rotatable independently of the photoreceptive drum in both forward and reverse directions relative to the photoreceptive drum and disposed on a side of the photoreceptive drum, and having a cam groove formed on an outer circumferential surface thereof; and a developing unit having a housing containing developer and a developing roller supported by both sidewalls of the housing, and having a shaft contacting the outer circumferential surface of the disc.

* * * * *